US012421705B2

(12) United States Patent
Wirtanen

(10) Patent No.: US 12,421,705 B2
(45) Date of Patent: Sep. 23, 2025

(54) SINK AND BATH DRAIN STRAINER

(71) Applicant: John Wirtanen, Elyria, OH (US)

(72) Inventor: John Wirtanen, Elyria, OH (US)

( * ) Notice: Subject to any disclaimer, the term of this patent is extended or adjusted under 35 U.S.C. 154(b) by 154 days.

(21) Appl. No.: 18/332,929

(22) Filed: Jun. 12, 2023

(65) Prior Publication Data

US 2024/0410150 A1 Dec. 12, 2024

(51) Int. Cl.
*E03C 1/264* (2006.01)

(52) U.S. Cl.
CPC ..... *E03C 1/264* (2013.01)

(58) Field of Classification Search
CPC . E03C 1/264; E03C 1/262; E03C 1/26; A47K 1/14; E03F 5/0404
See application file for complete search history.

(56) References Cited

U.S. PATENT DOCUMENTS

| | | | | | |
|---|---|---|---|---|---|
| 171,002 | A * | 12/1875 | Donovan | E03C 1/262 | 4/287 |
| 2,021,410 | A * | 11/1935 | Foose | E03C 1/262 | 4/287 |
| 2,166,273 | A * | 7/1939 | Ulmer | E03C 1/262 | 251/304 |
| 2,337,331 | A * | 12/1943 | Kirschner | E03C 1/262 | 4/287 |
| 4,932,082 | A * | 6/1990 | Ridgeway | E03C 1/2302 | 4/287 |
| 9,624,656 | B2 * | 4/2017 | Colacino | E03C 1/262 | |
| 2023/0313518 | A1 * | 10/2023 | Zhang | E03F 5/0407 | 52/198 |

* cited by examiner

*Primary Examiner* — Janie M Loeppke
(74) *Attorney, Agent, or Firm* — SLEMAN & LUND LLP

(57) ABSTRACT

A drain strainer includes a drain piece having a hollow body and an internal female thread, and a cap having an external male thread for mating with the internal female thread.

5 Claims, 4 Drawing Sheets

SINK AND BATH DRAIN STRAINER

FIELD OF THE DISCLOSURE

The present disclosure relates to drain strainers and, more particularly, a sink and bath drain strainer having a coupleable water flow stopper.

BACKGROUND OF THE DISCLOSURE

One of the primary causes of plumbing clogs is the presence of loose hair and objects such as jewelry and other small debris that accidentally fall into sink and bathtub drains. Over time, these objects accumulate and form clumps, obstructing the water flow within the plumbing system. These clumps can impede water pressure and create strain, which might go unnoticed until significant damage occurs, or until the water flow is completely blocked. In severe cases, the buildup of debris and hair can lead to overflow and backups, which requires the care of costly plumbing services.

A common drain plug or pop-up stopper includes a circular stopper coupled to an elongated plastic body and holes at the bottom of the body for attachment. Such a stopper breaks or clogs easily, and is usually discarded, which creates a large drain hole where objects can be lost. Other existing solutions in the prior art include the use of mesh screens or strainers placed over the drain opening to prevent small objects from entering the plumbing system. While these disclosures effectively prevent debris from causing blockages, they do not offer a mechanism to stop or control water flow as intended with standard pop-up drain stoppers.

SUMMARY OF THE DISCLOSURE

In some examples, a drain strainer includes a drain piece having a hollow body and an internal female thread, and a cap having an external male thread for mating with the internal female thread.

BRIEF DESCRIPTION OF THE DISCLOSURE

Embodiments of the presently disclosed sink and bath drain strainer are shown herein with reference to the drawings, wherein:

FIGS. 1A-D are schematic isometric and side views of a sink drain piece and its respective cap cover, according to a first embodiment; and FIGS. 2A-D are schematic isometric and side views of the bath drain piece and its respective cap cover, according to a second embodiment.

The embodiment of the present disclosure will now be described with reference to the appended drawings. It is to be appreciated that these drawings depict only some embodiments of the invention and are therefore not to be considered limiting of its scope.

DETAILED DESCRIPTION

Despite the various improvements that have been made to drain strainers and their methods of use, conventional devices suffer from some shortcomings as described above.

There therefore is a need for further improvements to the devices, systems, and methods of blocking small debris and regulating water from flowing into drains. Among other advantages, the present disclosure may address one or more of these needs.

Figure 1A:
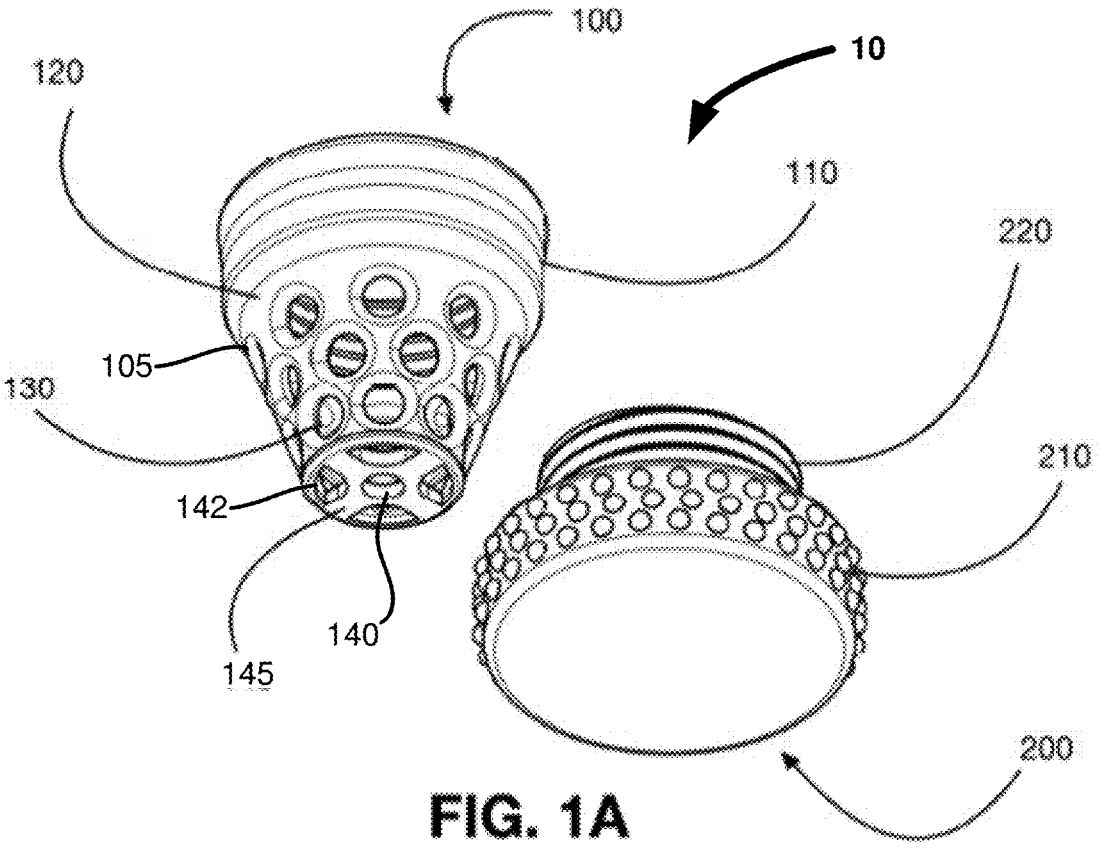
Figure 1B:
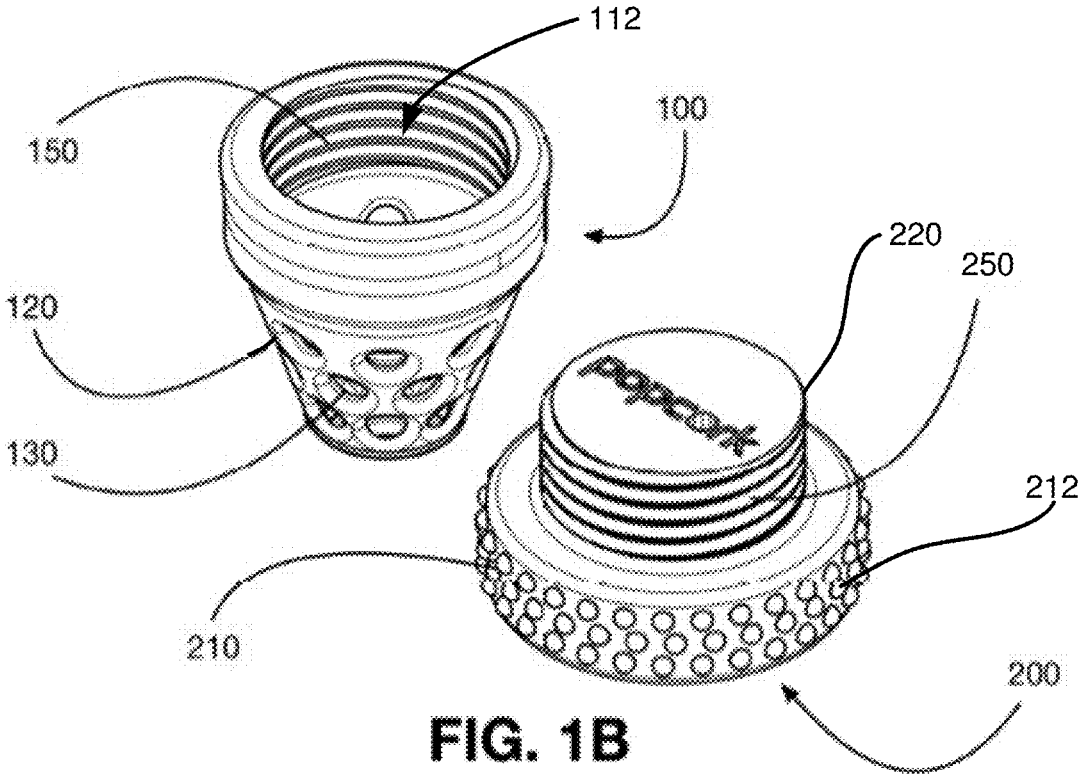

FIG. 1A illustrates a two-part drain strain 10 that includes a sink drain piece 100 and a corresponding sink cap 200. The sink drain piece 100 comprises a substantially hollow body 105 with a uniform section 110 and a tapered section 120. Uniform section 110 may be substantially cylindrical with a diameter of between 1" and 2" or having a predetermined standard diameter to fit existing drain sizes. The tapered section 120 may include a conical shape or a gradually decreasing diameter as it extends away from the uniform section 110. Tapered section 120 may include a plurality of peripheral drain holes 130 arranged in rows. In some examples, three rows of peripheral drain holes 130 are formed on the tapered section 120, although it will be understood that one, two, three, four or more rows of peripheral drain holes 130 are possible. In the example shown, the peripheral drain holes in the uppermost row are more spaced apart than peripheral drain holes in subsequent rows. In some examples, the same number of peripheral drain holes are formed in each of the rows. In some examples, the peripheral drain holes in one row are staggered with peripheral drain holes in an adjacent row as shown. In some examples, peripheral drain holes 130 may be approximately 1/16" to 1/4" in diameter (e.g., 4 mm in diameter). The sink drain piece 100 may include ribs 145 (e.g., cruciform ribs as shown) that define a central aperture 140 and a plurality of marginal apertures 142. Four ribs 145 are shown that divide the bottom of the sink drain piece 100 into a central aperture 140 and four wedge-shaped marginal apertures 142. As shown in FIG. 1B, sink drain piece 100 may include a main opening 112 in communication with peripheral drain holes 130, central aperture 140 and marginal apertures 142. Sink drain piece 100 may be inserted into a drain following the tapered section 130 for a convenient fit. Once the sink drain piece 100 is in place, slight force may be applied on upper edges of uniform section 110 to push it downwards, ensuring that the uniform section 100 is tightly pressed into the drain. With sink drain piece 100 properly positioned in the sink drain, water entering main opening 112 may flow through peripheral drain holes 130, central aperture 140 and marginal apertures 142 and without any issues. Simultaneously, because peripheral drain holes 130, central aperture 140 and marginal apertures 142 having a smaller cross-sectional area than main opening 112, debris that manages to enter the main opening 112 will be captured within the hollow body and be prevented from entering or becoming lost in the plumbing system.

Figure 1C:
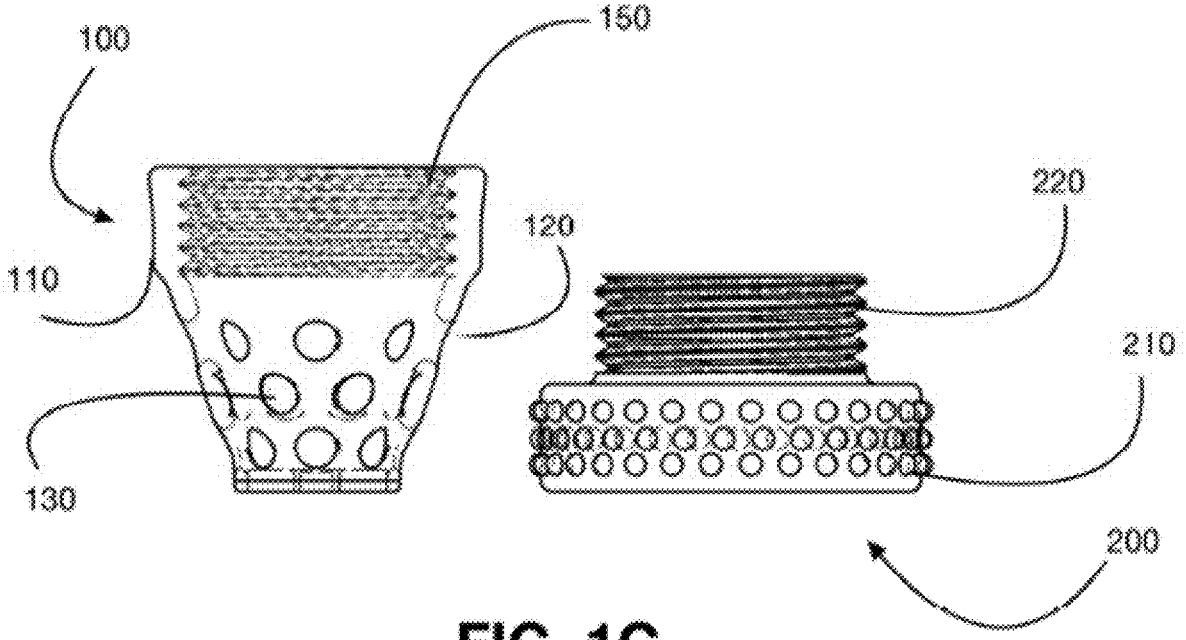
Figure 1D:
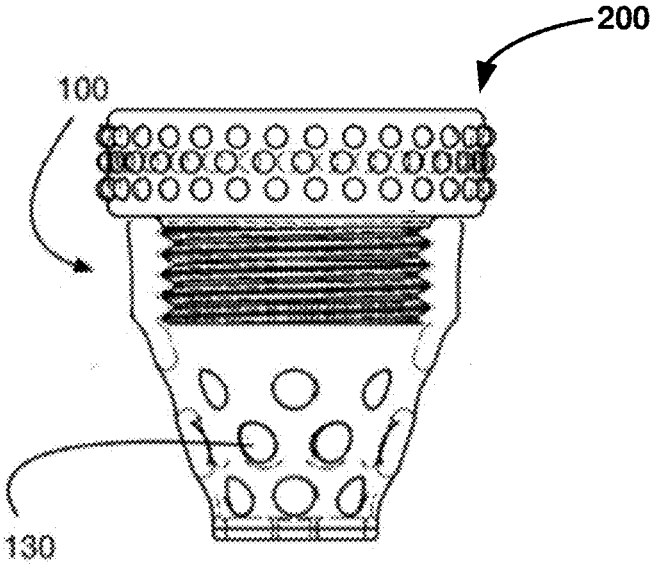

In FIG. 1B, a top view of the sink drain piece 100 and sink cap 200 is presented. It reveals that the sink drain piece 100 may incorporate internal female threads 150 in its concavity (e.g., within uniform section 110). Sink cap 200 may include a grip 210 having a plurality of protuberances or textured features 212 and a reduced cylindrical section 220 having male threads 250, which can be coupled with, or mated with, female threads 150 of sink drain piece 100. Generally, when cleaning the sink drain piece 100, it can be challenging to remove lingering debris. In such cases, the sink cap 200 can be threaded into the sink drain piece 100 and pulled using the grip 210 to remove the device (See, FIG. 1D). Moreover, sink cap 200 can be utilized to regulate the water flow into the sink drain piece 100. By screwing the sink cap 200 tightly into the sink drain piece 100, water entry is prevented, which may allow the user to fill the sink. As depicted in FIG. 1C, in some examples, the female threads 150 end when the uniform section 110 begins to taper. In some examples, male threads 250 on sink cap 200 are designed to match the length of the female threads 150 so that partial obstruction is possible, which gradually increases until the sink cap 200 completely obstructs water flow.

Figure 2A:
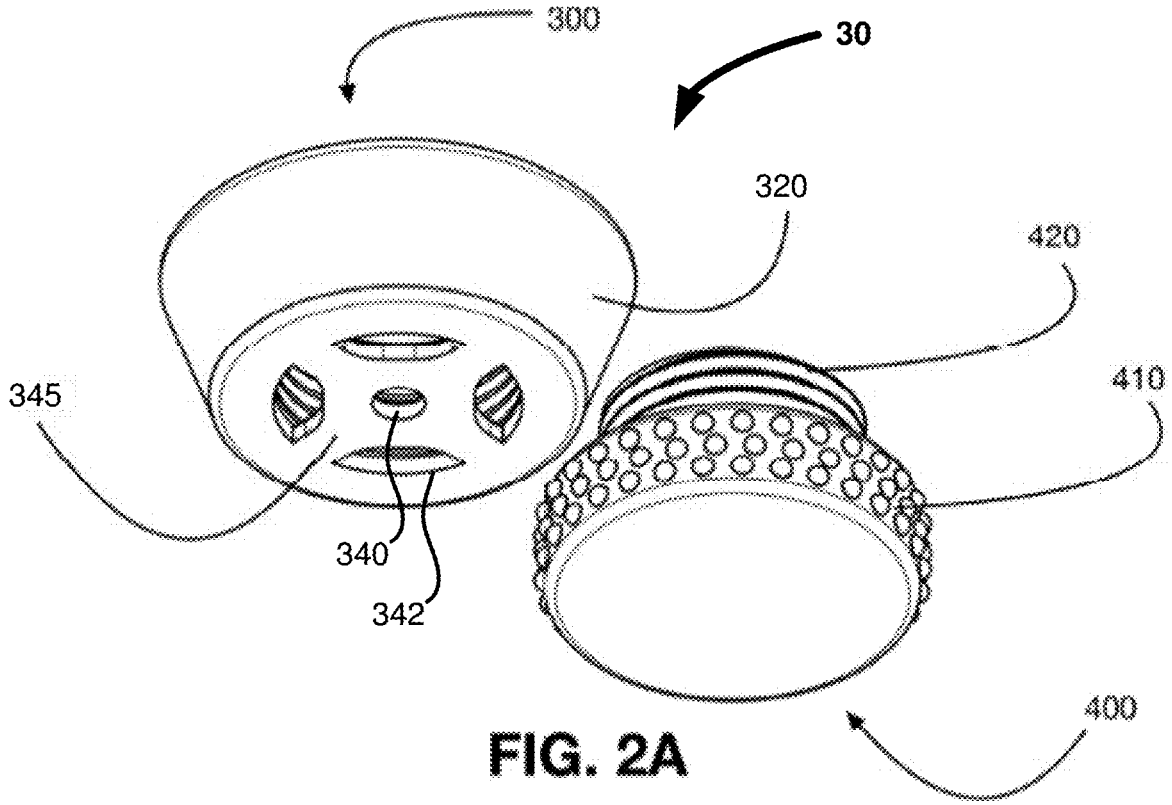
Figure 2B:
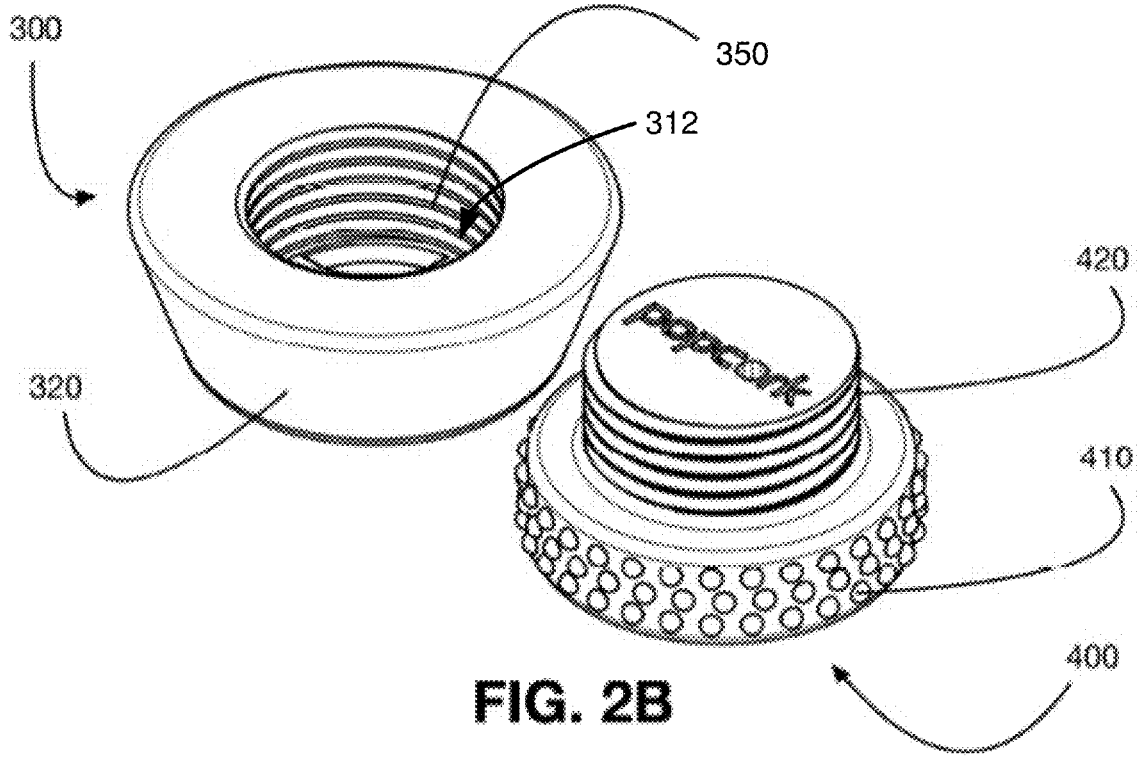
Figure 2C:
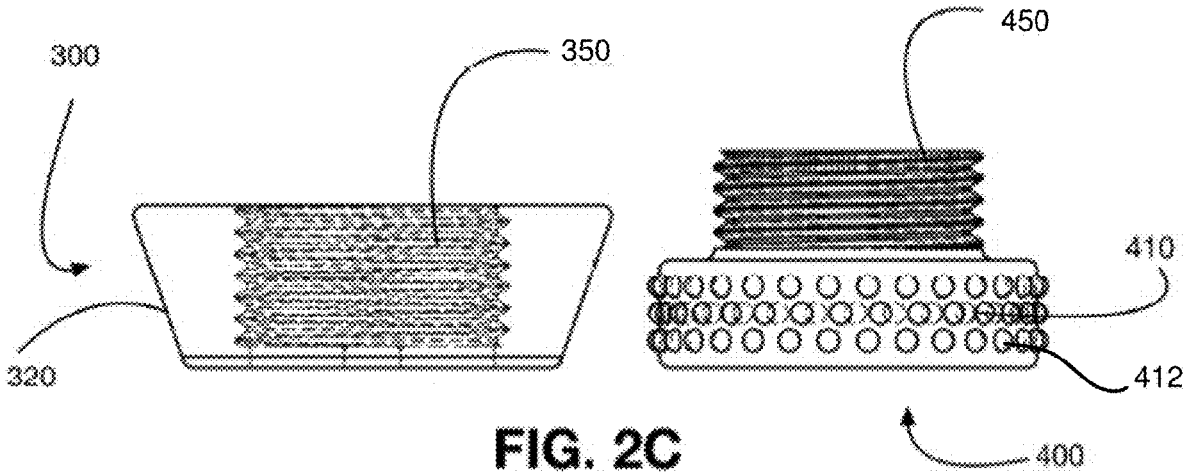
Figure 2D:
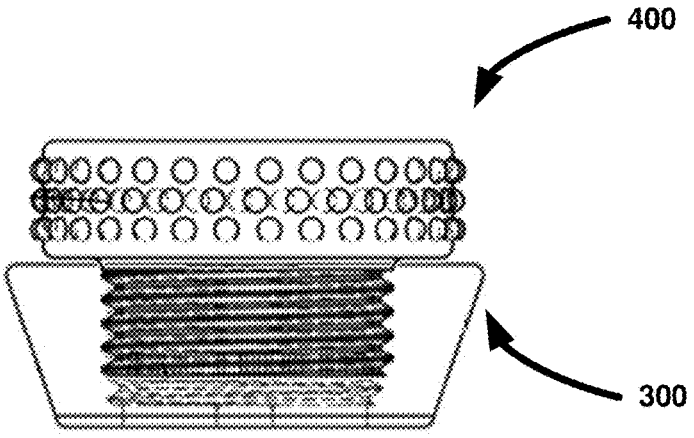

FIG. 2A illustrates a two-part drain strain 30 that includes bath drain piece 300 and the corresponding bath cap 400 according to another embodiment. The bath drain piece 300 comprises a substantially hollow body 305 with a tapered section 320 but no uniform section. Tapered section 320 may include a conical shape or a gradually decreasing diameter as shown, but does not include peripheral drain holes. Similar to the sink drain piece 100, found in FIGS. 1A-C, drain piece includes ribs 345 (e.g., cruciform ribs as shown) that define a central aperture 340 and a plurality of marginal apertures 342. As shown in FIG. 2B, sink drain piece 300 may include a main opening 312 in communication with central aperture 340 and marginal apertures 342. The bath drain piece 300 may be inserted into a bath drain by pushing it in, ensuring a seamless fit. Once the bath drain piece 300 is in position, slight force is applied to push it downwards, tightly securing the tapered section 320 within the drain. The central aperture 340 and marginal apertures 342 allow unimpeded water flow while preventing the entry of small debris into the plumbing system through the drain.

In FIG. 2B, a top view of the bath drain piece 300 and bath cap 400 is depicted. It reveals that the bath drain piece 300 incorporates female threads 350 in its cylindrical concavity. The bath cap 400 comprises the grip 410 having a plurality of protuberances or textured features 412 and male threads 450, which can be threaded into the female threads 350. Generally, when cleaning the bath drain piece 300, it can be difficult to remove persistent debris. In such cases, the bath cap 400 can be threaded into the bath drain piece 300 and pulled using the grip 410 to remove the device. Additionally, the bath cap 400 can be employed to regulate the water flow into the bath drain piece 300. By screwing the bath cap 400 tightly into the bath drain piece 300, water entry is prevented, which allows the bath to be filled. The male threads 450 may be designed to match the length of the female threads 350 so that when fully screwed in, the bath cap 400 effectively blocks any water flow.

Although the disclosure herein has been described with reference to particular embodiments, it is to be understood that these embodiments are merely illustrative of the principles and applications of the present disclosure. It is therefore to be understood that numerous modifications may be made to the illustrative embodiments and that other arrangements may be devised without departing from the spirit and scope of the present disclosure as defined by the appended claims.

It will be appreciated that the various dependent claims and the features set forth therein can be combined in different ways than presented in the initial claims. It will also be appreciated that the features described in connection with individual embodiments may be shared with others of the described embodiments.

What is claimed is:

1. A drain strainer, comprising:

a drain piece having a hollow body defining a main opening and a central aperture disposed opposite the main opening and in fluid communication therewith, the central aperture having a smaller cross-sectional area than the main opening, the drain piece comprising i) a docking section with a predetermined diameter configured and arranged to be friction fit entirely within a sink drain, the docking section having an internal female thread, and ii) a tapered section, the tapered section comprising a plurality of peripheral drain holes arranged in rows within the tapered section and spaced away from the docking section; and a cap having a cylindrical section with a first diameter, and a grip section having a second diameter, the second diameter being greater than the first diameter, the cylindrical section being configured to fit entirely within the docking section of the drain piece and having an external male thread for mating with the internal female thread of the drain piece, and the grip section being disposed entirely above the drain piece when the cap is mated with the drain piece, and having a textured surface to remove the drain piece from a sink drain.

2. The drain strainer of claim 1, wherein the plurality of peripheral drain holes are arranged in three rows.

3. The drain strainer of claim 2, wherein each of the plurality of peripheral drain holes has a smaller cross-sectional area than the main opening.

4. The drain strainer of claim 1, further comprising a plurality of marginal apertures arranged about the central aperture.

5. The drain strainer of claim 1, wherein the cap comprises a grip section with a textured surface.

* * * * *